United States Patent [19]

Gerber et al.

[11] 4,153,462

[45] May 8, 1979

[54] METHOD OF MAKING SILVER HALIDE EMULSIONS

[75] Inventors: Arthur M. Gerber, Boston; Vivian K. Walworth, Concord, both of Mass.

[73] Assignee: Polaroid Corporation, Cambridge, Mass.

[21] Appl. No.: 604,889

[22] Filed: Aug. 14, 1975

Related U.S. Application Data

[63] Continuation-in-part of Ser. No. 311,690, Dec. 4, 1972, abandoned.

[51] Int. Cl.[2] ..... G03C 1/02

[52] U.S. Cl. ..... 96/94 R; 423/34

[58] Field of Search ..... 96/80, 94 R, 100, 107, 96/108, 113; 423/34

[56] References Cited

U.S. PATENT DOCUMENTS

| | | | |
|---|---|---|---|
| 1,503,595 | 8/1924 | Mees | 96/95 |
| 3,511,662 | 5/1970 | Jouy | 96/94 |
| 3,600,175 | 8/1971 | Anderson | 96/94 R |
| 3,883,355 | 5/1975 | Walworth | 96/94 R |
| 3,941,600 | 5/1976 | Walworth | 96/94 R |

*Primary Examiner*—David Klein
*Assistant Examiner*—John L. Goodrow
*Attorney, Agent, or Firm*—Philip G. Kiely

[57] ABSTRACT

The present invention is directed to a method for forming the crystals of a photographic silver halide emulsion which comprises crystallizing silver halide grains from a solution of a water-soluble complex of silver halide complexed with excess halide ions. The crystals may be sensitized before the binder is added.

17 Claims, 1 Drawing Figure

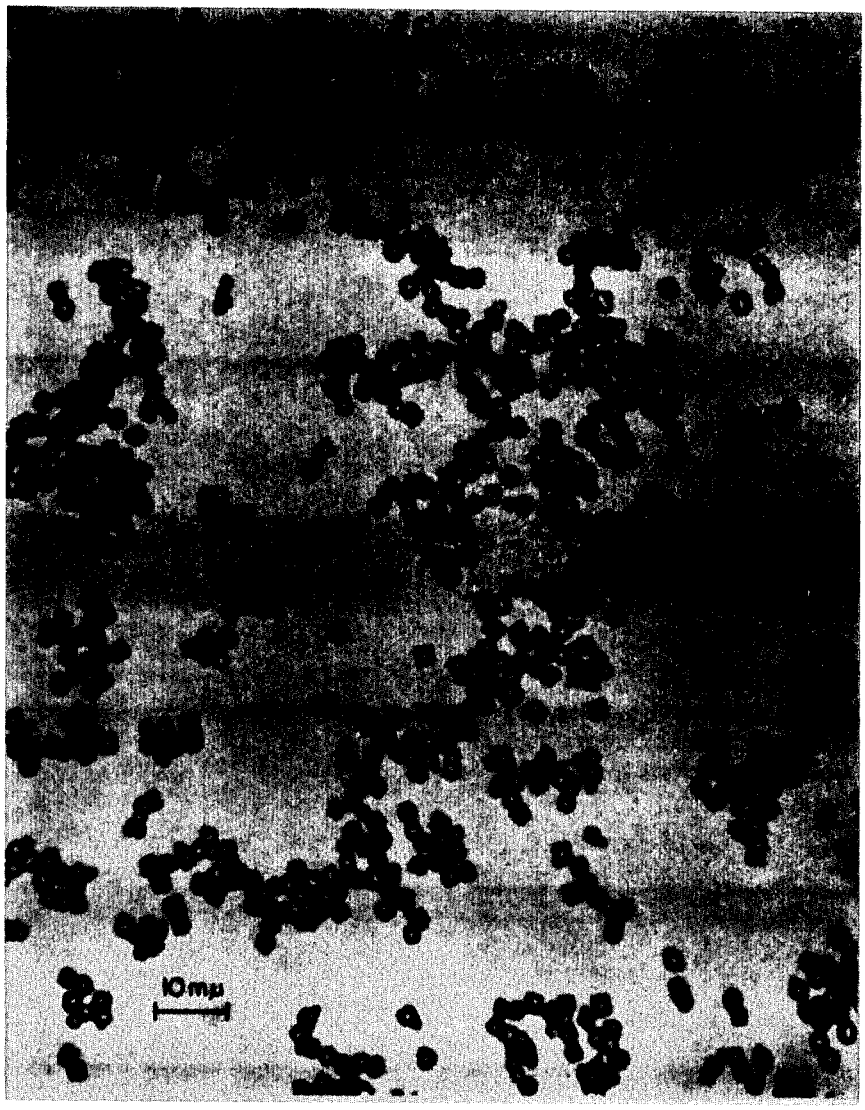
10 mμ

METHOD OF MAKING SILVER HALIDE EMULSIONS

CROSS REFERENCE TO OTHER APPLICATIONS

This application is a continuation-in-part of application Ser. No. 311,690, filed Dec. 4, 1972, now abandoned.

BACKGROUND OF THE INVENTION

Photographic silver halide emulsions are generally prepared by precipitation of the silver halide in the presence of a carrier or binder, generally gelatin, wherein the silver halide crystals are formed by the interaction of a water-soluble silver salt, such as silver nitrate, and a water-soluble halide, such as potassium bromide. The term "crystal" as used herein refers to a crystalline particle of silver halide, sometimes referred to as a grain, and should be understood to include particles of any composition of silver halide with any mixture of crystal habits. Subsequent to the precipitation, the mixture is heated for a given period of time. Additional binder may be added at this point. The binder-silver halide mixture is then generally chilled, noodled and washed to remove the soluble salts. The mixture may again be melted, chilled and washed if desired. Various substances such as sensitizers, coating aids, and the like, may also be added to the emulsion during its preparation, generally after the washing stage, and a heat treatment may be applied to induce the process known as chemical sensitization.

From the foregoing, it will be noted that the formation of the silver halide crystals and the sensitization takes place in the presence of a binder material. Gelatin is the most commonly used binder material for silver halide, but other materials such as synthetic polymers are also employed. It is a requirement of the binder material that it permit the growth of silver halide crystals but that the growth not be too rapid to prevent crystals of undesirable size from being formed. It is also a requirement that the binder material allow the various sensitization processes to take place. These requirements disqualify a large number of synthetic polymeric materials from being employed in silver halide emulsions when otherwise they may possess other properties desired in such employment. In addition, because the reaction forming the silver halide grains takes place in the presence of the binder, starting materials are entrapped therein which require careful and extensive washing procedures.

It is also known that silver ions can form water-soluble complex ions with numerous inorganic and organic compounds. Specific silver halide complexes include the $AgCl_2^-$, $AgCl_4^{-3}$, $AgBr_3^{-2}$, $AgBr_5^{-4}$, $Ag_2Br^+$, $AgI_2^-$, $AgI_4^{-3}$, $AgCl_3Br^{-3}$, $Ag_3I^{+2}$ and $AgClBr_3^{-3}$ complexes. It is believed that the foregoing complexes participate in the growth of the silver halide crystals during physical ripening of the emulsion and influence the kinetics of development. The above-mentioned complexes are known to the art and are set forth on page 8 of Mees, *The Theory of the Photographic Process,* Third Edition, MacMillan Company, New York.

It is with the above-described silver complexes that the present invention is concerned.

SUMMARY OF THE INVENTION

The present invention is directed to a method for forming a silver halide photographic emulsion which comprises forming a water-soluble complex of silver halide complexed with excess halide and breaking the complex by dilution, to provide for the precipitation of silver halide crystals, wherein the dilution medium contains an agent for modulating the crystallization of said crystals, preferably in the absence of a binder material, removing said silver halide crystals from the diluting medium and dispersing said silver halide crystals in a binder for coating on a support. It is further directed toward a method of sensitizing such crystals before the crystals are dispersed in a binder.

BRIEF DESCRIPTION OF THE DRAWING

The FIGURE is a photomicrograph of silver halide crystals prepared in accordance with the method of the present invention.

DETAILED DESCRIPTION OF THE INVENTION

The present invention involves the formation of silver halide crystals for a photographic emulsion from a water-soluble silver halide complex. As stated above, such water-soluble silver halide complexes are known to the art. In contrast to conventional emulsion preparation, the present invention does not employ the reaction of a silver salt with a water-soluble halide to produce the chemical reaction therebetween and resultant precipitation of silver halide crystals. Such conventional methods are generally carried out in the presence of a substantial amount of colloid binder material to provide an environment which permits the growth of the silver halide crystals to the desired size and to prevent agglomeration of grains during the growth process.

The present invention contemplates the formation of silver halide crystals from an inorganic complex, namely, a water-soluble complex of silver halide complexed with excess halide. By at least partially breaking the complex, i.e., decomplexation, insoluble silver halide crystals are produced which precipitate and are collectable from the bottom of the dilution vessel. The specific conditions employed in forming the crystals as well as the presence of an agent for modulating the crystallization regulate the crystal size and habit.

The decomplexation is preferably achieved by a dilution of the solution containing the complex to a sufficient degree to result in the break-up of the complex to produce the resulting water-insoluble precipitate. The specific degree of dilution is not critical; it is only necessary that the solution be diluted sufficiently to provide the decomplexation and precipitation. The solution is preferably added rapidly to a diluting medium and the decomplexation and crystal formation is substantially instantaneous, i.e., on the order of milliseconds to tenths of a second.

Having carried out the steps necessary to provide the precipitate, separation of the thus-formed silver halide crystals is relatively easy. Since the dilution is carried out in the absence of a binder or with only a relatively small quantity of binder, but rather in a medium which is a dilution medium for the silver halide complex but in which the silver halide crystals are insoluble, the excess complex solution may be decanted and the silver halide crystals recovered by conventional filtering means. The crystals may be washed and given any optional treatments desired such as those which will be discussed below, and then dispersed in a suitable binder material, thereby providing a photographic silver halide emulsion in a relatively short period of time with a minimum of equipment and processing steps. The extensive washing operations which are necessary in conventional processes to free the binder from excess soluble salts are avoided.

The novel process of the present invention is preferably carried out by forming a water-soluble complex of silver wherein the anion is chloride, bromide or iodide. For example, silver nitrate may be reacted with potassium bromide and/or calcium bromide to form silver bromide. Silver bromide solid is also commercially obtainable. The silver bromide is then added to a solution of a soluble bromide such as calcium bromide, lithium bromide or potassium bromide to produce silver bromide complex. The solution of the complex is preferably a saturated solution, but it is not critical that it be saturated. The thus-formed soluble complex is decomplexed by adding the solution to a vessel containing a suitable dilution medium and the agent for modulating crystallization. The relatively rapid change in the concentration results in breaking the complex, forming water-insoluble silver halide crystals which precipitate from the solution. The excess complex salts which remain in solution are easily removed and the thus-formed grains can be washed and dispersed in a suitable binder and then coated on a support. If desired, the emulsion may be ripened. Chemical and spectral sensitizers may be added to the silver halide crystals prior to or subsequent to dispersing the crystals in the binder. Preferably, the sensitizers are added prior to dispersing the silver halide crystals in the binder to permit more efficient contact with the crystals.

While dilution is the preferred method of decomplexation, it should be understood that other conventional methods of crystallization may be employed in combination with dilution such as temperature change, evaporation, and nucleation and combinations of such conditions.

In a particularly preferred embodiment, the complex solution is formed at elevated temperatures to provide optimum solubility of the complex. The dilution is carried out at a lower temperature to provide enhanced yield of silver halide precipitate.

By means of the present invention, a variety of crystal sizes may be produced. In order to obtain finer crystals, it may be desired to provide nucleating material to the diluting medium. The nucleating material may comprise substantially any particulate material, that is, an insoluble substance of a size smaller than the desired grain size. The specific material chosen is not critical. As examples of a suitable particulate nucleating material, mention may be made of finely divided silica, carbon black, mica, heavy metal sulfides, such as gold sulfide, colloidal gold, silver iodide, colloidal silver and colloidal silver bromide.

In the preferred embodiment, a halide salt is added to the diluting medium, thereby modulating the rapidity with which the complex is broken and crystal formation occurs. If the halide in the diluting medium is the same as the halide in the complex, crystal formation will be slowed, resulting in relatively large grain formation. If a halide other than the halide in the complex is employed in the diluting medium, precipitation and crystal formation are accelerated, resulting in smaller silver halide crystals, provided that the halide in the diluting medium forms a less soluble silver halide than the halide of the complex. In this situation, the breaking of the complex will be relatively rapid and complete, with the formation of a core of silver halide wherein the halide is the halide employed in the diluting medium. The less soluble silver halide (halide of diluting medium) functions as a nucleus around which silver halide crystal (halide of the complex) forms. It should be understood that a combination of different halides at different ratios may be used in the diluting medium.

A particular advantage of the method of the present invention is that relatively uniform crystals of substantially any desired size from less than 0.1 micron to greater than 10 microns can be formed in less than a second at room temperature by selecting the appropriate conditions for dilution. For example, in general, the higher the concentration of soluble halide in the diluting medium prior to crystallization, the larger the crystals that are produced. Conversely, the less soluble the halide in the diluting medium, the smaller the crystals produced. In this case the halide of the diluting medium and the halide of the complex are the same halide.

In employing a salt of a halide in the diluting medium, it has been found that a wide variety of cations may be employed. As examples of suitable cations, mention may be made of potassium, lithium, sodium, rubidium, calcium, strontium, barium and ammonium. In addition to performing the desired modulation effect on the crystallization process, it has also been found that the employment of the aforementioned cations does not interfere with the photographic performance of the emulsion prepared from the silver halide crystals formed in the process of the present invention.

It has also been found that various organic solvents which are miscible with water may be employed in the diluting medium in order to provide various modifications to the silver halide crystal. As examples of solvents which may be employed, mention may be made of dimethyl sulfoxide, ethanol, 2-methoxy ethanol, acetone and dimethyl formamide.

It is unexpected that organic solvents can be employed successfully in the present invention since it has been generally believed in the art that the presence of organic solvents in a gelatin/silver halide emulsion results in undesirable side effects. For example, hardened particles of the emulsion may be produced which could cause trouble in the coating of the emulsion on a support. Thus, the art has been particularly concerned with avoiding the use of organic solvents in emulsions or carefully washing the emulsions to free them from any traces of organic solvents. See British Pat. No. 1,121,174 regarding the undesirability of organic solvents in silver halide emulsions.

The crystallization of the silver halide may also be modulated by the employment of other materials dissolved in the dilution medium such as sodium tetrachloroaurate (III), chitin, ammonium hydroxide, and surfactants such as the sodium salt of polymeric carboxylic acids, nonylphenyl polyethylene glycol ether and the dicarboxylic linoleic derivative sodium salt.

It will be noted that the makeup of the diluting medium can be modified by the addition of combinations of the aforementioned materials at varying concentrations in order to achieve a silver halide crystal of predetermined size and shape as well as composition, since the halide ratios of crystals have a known effect on sensitivity and other properties.

The aforementioned nucleating material, halide salts, organic solvents and the like are designated "agents for modulating crystallization" for the purposes of this invention.

As stated above, sensitization can be carried out by contacting the crystals with conventional chemical and spectral sensitizers in the absence of binders. Since binders generally act to retard the rapidity of contact and adsorption of the sensitizing agents, it will be seen that enhanced speed and effectiveness of contact is achieved in the present invention. To counteract the modulatory effect of the binder in conventional emulsion sensitization, elevated temperatures and extended periods of time are necessary. In the present invention, however, sensitization can be achieved in a relatively short time at room temperature or temperatures slightly above room temperature.

The following non-limiting examples illustrate the preparation of emulsions within the scope of the present invention. In the following examples, the saturated silver halide complex solution was prepared by solubilizing silver bromide with a soluble bromide, i.e., by adding potassium, calcium or lithium bromide and silver bromide solids to water at room temperature until the halides no longer dissolve to provide a solution of about 8N to 10N bromide and about 0.3N to 0.5N silver.

EXAMPLE I

One hundred milliliters of saturated silver bromide complex prepared by solubilizing silver bromide with potassium bromide was rapidly added to a solution comprising 48 milliliters of water, 40 milliliters of saturated potassium bromide and 20 milliliters of 0.01N potassium iodide at room temperature. The mixture was stirred for 30 seconds and then the silver bromide was allowed to precipitate, which precipitation occurred within about 30 seconds. The excess salts in solution were decanted and the silver halide crystals were washed with water and dispersed in gelatin. The crystal size ranged from about 0.1 to 1.0$\mu$ in diameter. The gelatin/silver bromide mixture was coated on a baryta support at a level of 50–150 mg. of silver per square foot and exposed to blue light through a step wedge with one-half stop increments. The thus-exposed emulsion was then processed with Type 107 receiving sheet and processing composition (Polaroid Corporation, Cambridge, Mass.) by diffusion transfer processing. Observation of the results indicated that a high speed photographic emulsion was produced.

EXAMPLE II

Five ml. of a saturated solution of silver bromide complex prepared as in Example I was rapidly added at room temperature to 4 ml. of water and 1 ml. of saturated potassium bromide at room temperature. The precipitated silver bromide crystals were approximately 5 microns in size and six pointed "jacks" in configuration.

EXAMPLE III

One hundred ml. of a saturated silver bromide complex prepared as in Example I was rapidly added at room temperature to a mixture of 48 ml. of water, 40 ml. of saturated potassium bromide and 20 ml. of 0.01N potassium iodide. The solutions were filtered prior to addition to remove extraneous materials. The resulting silver iodobromide crystals were approximately 1 micron in size. The crystals were removed from the solution, washed with water and dispersed in gelatin. The gelatin silver bromide mixture was coated on a baryta support (50–150 mgs. of silver/ft.$^2$ of silver) and exposed to blue light through a step wedge with one-half stop increments. The thus-exposed emulsion was then processed with Type 42 receiving sheet and processing composition (Polaroid Corporation, Cambridge, Mass.) by diffusion transfer processing. Observation of the results indicated that a photographic silver halide emulsion of good speed was produced.

EXAMPLE IV

Five ml. of a saturated silver bromide solution prepared as in Example I was rapidly added to 1.4 ml. of water, 2.0 ml. of saturated potassium bromide and 1 ml. of 0.01N potassium iodide. The silver bromide crystals obtained were relatively uniform in size, about 2 microns in diameter, and had a generally octahedral habit. The FIGURE is an optical photomicrogaph of the crystals.

EXAMPLE V

Five ml. of a saturated silver bromide solution prepared as in Example I was rapidly added to 1 ml. of dimethyl formamide, 3 ml. of water and 1 ml. of saturated potassium bromide. The precipitated silver bromide crystals were approximately 20 microns in diameter.

EXAMPLE VI

Five ml. of a saturated silver bromide solution prepared as in Example I was added to 1 ml. of dimethyl sulfoxide, 3 ml. of water and 1 ml. of saturated potassium bromide. The precipitated silver bromide crystals were in excess of 10 microns in diameter.

EXAMPLE VII

Five ml. of a saturated silver bromide solution prepared as in Example I was added to 1 ml. of gold sulfide ($10^{-4}$ molar), 3 ml. of water and 1 ml. of saturated potassium bromide. The precipitated silver halide crystals were about 1 micron in diameter.

EXAMPLE VIII

A saturated silver bromide solution was prepared by adding 1400 g. of lithium bromide to 650 ml. of water and cooling. To this solution was added 85 g. of silver nitrate and 100 ml. of water. The resulting mixture was cooled to room temperature and allowed to equilibrate for two hours, The supernatant liquid was decanted and filtered. 45 ml. of the filtered solution was added to a solution of 10 ml. of water, 30 ml. of potassium iodide (1.160 g. per liter of water) and 5 ml. of saturated lithium bromide solution and mixed for three minutes. The supernatant liquid was decanted and the precipitate washed six times with 250 ml. of distilled water per wash. 0.3 ml. of a solution of 1 g. of sodium thiosulfate per 99 ml. of water and 0.4 ml. of a gold sensitizer prepared by adding 3 ml. of 1% gold chloride to 25 ml. of 1% ammonium thiocyanate were added to the precipitate and mixed for one minute. 2 ml. of a panchromatic sensitizer of the formula:

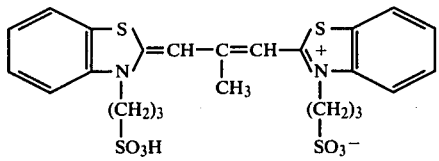

(1 mg. of dye per ml. of water) and mixed for three minutes. The mixture was then placed in a sonic agitator with a frequency of 55,000 cycles/sec. for five minutes. After five minutes, 8 ml. of inert gelatin (20%) was added over a ten minute period, with the sonification continuing during the addition. The silver bromide crystals were approximately 0.1–1 micron in diameter. The emulsion was coated on a baryta support (50–150 mgs. of silver per square foot) and exposed through a step wedge with one-half stop increments. The thus-exposed emulsion was processed with a Type 42 receiving sheet and processing composition (Polaroid Corporation, Cambridge, Mass.) by diffusion transfer processing. Compared to a control emulsion prepared in the same fashion without the described chemical or spectral sensitization, substantially enhanced speed was observed. A reflection density of a full silver transfer area showed a $D_{max}$ in excess of 1.5.

EXAMPLE IX

One hundred and forty milliliters of a saturated silver bromide complex prepared by solubilizing silver bromide with calcium bromide was rapidly added to a solution comprising 80 milliliters of water, 50 milliliters of saturated calcium bromide and 30 milliliters of 0.01N potassium iodide at room temperature. The silver bromide crystals formed were generally triangular and hexagonal plates ranging in size from about 1 to 10 microns in diameter.

In order to facilitate the dispersion of the silver halide grains in a binder, it may be desirable to employ a surfactant. A particularly preferred method for dispersing the silver halide crystals in a binder comprises the steps of adding a surfactant to the silver halide crystals, washing the surfactant from the crystals and then dispersing the silver halide crystals in the binder. It is believed that the surfactant functions to remove contaminants from the surface of the silver halide crystals which may provide a charge double layer which would result in the clumping of the crystals. By the aforementioned steps, which, in effect, is a purification process, the similarity of the charge on the crystals in a salt-free suspension provides a repellency which prevents agglomeration of the crystals, thus facilitating the uniform and ready dispersal of the crystals in the binder. In addition, removal of excess salts that may be present from the formation of the complex prevents recrystallization or fusion of the crystals. The surfactant is not critical and the surfactants conventionally employed in photographic chemistry are suitable. A preferred surfactant is Miranol, an amphoteric surface active agent sold by Mironal Chemical Company, Inc., Irvington, N.J.

The novel method of the present invention permits the use as a binder of a larger number of different polymers than the conventional processes. In conventional emulsion preparation, a binder material must be selected which will not interfere with the crystal growing and sensitizing process. Since the silver halide crystal has already been completely formed and, optionally, sensitized, prior to its disposition in a binder, the effect of the particular binder is not critical. Thus, a wide variety of both natural and synthetic polymers may be selected for employment in the present invention with regard to properties other than the ability to grow silver halide crystals therein.

With regard to the use of chemical sensitizing agents, mention may be made of U.S. Pat. Nos. 1,574,944; 1,623,499; 2,410,689; 2,597,856; 2,597,915; 2,487,850; 2,518,698; 2,521,926; and the like, as well as Neblette, C. B., *Photography Its Materials And Processes,* 6th Ed., 1962.

In addition to conventional sensitization techniques, the silver halide crystals may also be formed in the presence of sensitizers and/or sensitizers may be added after crystal growth and washing but prior to dispersal in a binder.

Spectral sensitization of the silver halide crystals may be accomplished by contact of the crystal composition with an effective concentration of the selected spectral sensitizing dyes dissolved in an appropriate dispersing solvent such as methanol, ethanol, acetone, water and the like; all according to the traditional procedures of the art, as described in Hamer, F. M., *The Cyanine Dyes And Related Compounds.*

Reduction sensitization of the crystals prior to the addition of the binder may also be accomplished employing conventional materials known to the art, such as stannous chloride.

Sensitizers of the solid semiconductor type, such as lead oxide, may also be employed.

Additional optional additives, such as coating aids, hardeners, viscosity-increasing agents, stabilizers, preservatives, and the like, for example, those set forth hereinafter, also may be incorporated in the emulsion formulation, according to the conventional procedures known in the photographic emulsion manufacturing art.

While the emulsions of the present invention have been described primarily in terms of diffusion transfer, it should be understood that substantially any type of photographic emulsion can be prepared.

What is claimed is:

1. A method of forming silver halide crystals which comprises crystallizing silver halide crystals from a solution of an inorganic water-soluble complex of silver halide complexed with excess halide, by disposing said solution in a dilution medium, wherein said dilution medium includes an agent for modulating the crystallization of said silver halide crystals and wherein said crystals are insoluble in said dilution medium.

2. A method as defined in claim 1 which includes the steps of separating the thus-formed crystals and dispersing said crystals in a binder.

3. A method as defined in claim 1 wherein said solution is a saturated solution of said silver halide complex.

4. A method as defined in claim 1 wherein said dilution medium is at a substantially lower temperature than said solution.

5. A method as defined in claim 1 wherein said agent is a water-soluble halide salt.

6. A method as defined in claim 5 wherein said water-soluble halide salt comprises the same halide as the halide of the water-soluble complex.

7. A method as defined in claim 5 wherein said halide salt comprises a halide different from the halide employed in the water-soluble complex.

8. A method as defined in claim 1 wherein said agent includes an organic solvent.

9. A method as defined in claim 2 wherein said binder is gelatin.

10. A method as defined in claim 2 which includes the steps of adding a surfactant to the silver halide crystals and washing out said surfactant prior to dispersing said silver halide crystals in the binder.

11. The method as defined in claim 1 wherein the crystallization occurs in the presence of a photographic sensitizer.

12. The method as defined in claim 1 wherein said agent is a particulate material.

13. The method as defined in claim 12 wherein said agent is silver bromide.

14. The method as defined in claim 1 wherein said agent is potassium iodide.

15. The method as defined in claim 1 which includes the step of contacting the thus-formed crystals with a photographic sensitizing agent.

16. The method as defined in claim 15 wherein said sensitizing agent is a chemical sensitizer.

17. The method as defined in claim 15 wherein said sensitizing agent is a spectral sensitizer.

* * * * *